US005232136A

United States Patent [19]

Unger

[11] Patent Number: 5,232,136

[45] Date of Patent: Aug. 3, 1993

[54] HOLDER FOR SCRAPERS

[75] Inventor: Henry M. Unger, Weston, Conn.

[73] Assignee: Unger Licensing Inc., Bridgeport, Conn.

[21] Appl. No.: 821,400

[22] Filed: Jan. 14, 1992

[51] Int. Cl.[5] ..... A45F 5/00

[52] U.S. Cl. ..... 224/151; 224/247; 224/252; 224/253; 224/269; 224/904

[58] Field of Search ..... 224/904, 247, 252, 253, 224/151, 269, 232

[56] References Cited

U.S. PATENT DOCUMENTS

| | | | |
|---|---|---|---|
| 1,504,927 | 8/1924 | Baust | 224/232 |
| 1,969,677 | 8/1934 | Stowell | 224/247 |
| 2,387,900 | 10/1945 | Hartwell | 224/242 |
| 3,294,298 | 12/1966 | Danielson | 224/904 |
| 3,430,760 | 3/1969 | Ulmer | 224/242 |
| 3,434,638 | 3/1969 | Beynon | 224/242 |
| 3,902,640 | 9/1975 | Geiben | 224/215 |
| 3,997,092 | 12/1976 | Pogwizd | 224/241 |
| 4,071,065 | 1/1978 | Halbich | 224/235 |
| 4,300,708 | 11/1981 | Pattermann | 224/253 |
| 4,598,027 | 7/1986 | Johnson | 224/904 |
| 5,056,696 | 10/1991 | Lahr | 224/148 |

*Primary Examiner*—Linda J. Sholl

*Attorney, Agent, or Firm*—Abelman Frayne & Schwab

[57] ABSTRACT

A holder for a naked, sharp-edged workman's tool is provided, which provides a safety shroud for the sharp edge of the workman's tool at the time it is inserted into the holder by a workman, the holder also providing for the support of a secondary retractable single-edged razor.

3 Claims, 3 Drawing Sheets

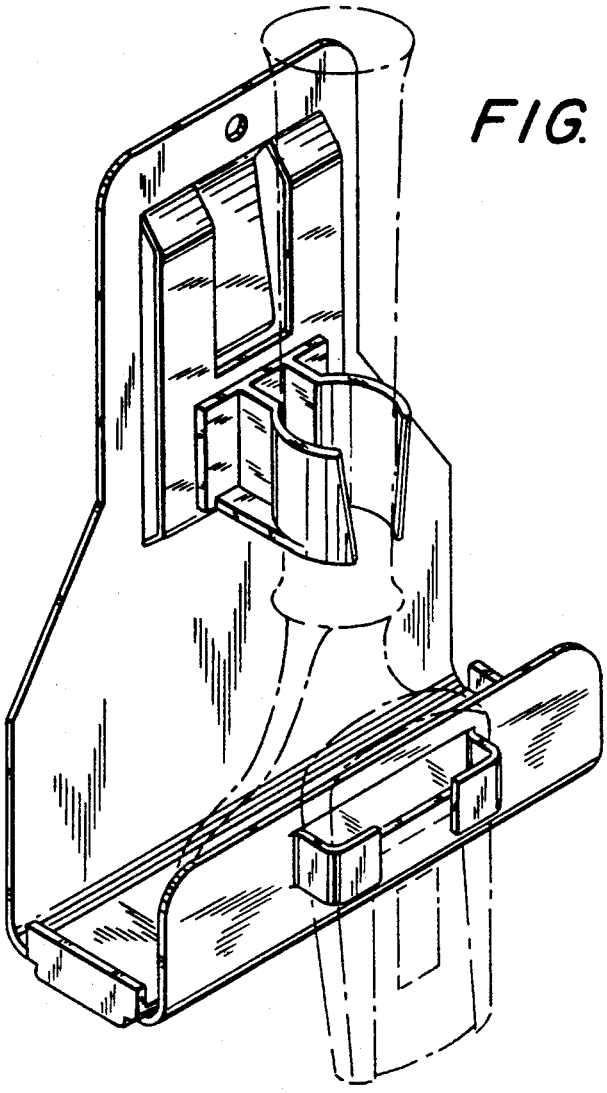
FIG. 1
FIG. 2
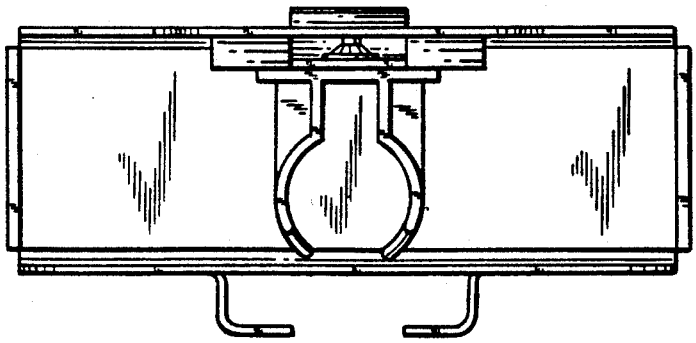

HOLDER FOR SCRAPERS

FIELD OF THE INVENTION

This invention relates to a device for use by workmen as the temporary storage for a naked sharp-bladed instrument while using an alternative tool in the performance of cleaning operation.

BACKGROUND OF THE INVENTION

It commonly occurs that a workman, when using hand-held tools, will find it necessary to store one of these tools while using another, and this, without the necessity of shrouding or otherwise covering what can be a razor-sharp cutting edge of the first-mentioned tool.

This commonly occurs in the trades of window cleaning, floor maintenance and the like, where the workman will find it necessary to use a relatively broad sharp-edged tool for the swift completion of an initial cleaning step, to be followed by, if necessary, a fine cleaning step requiring the use of a different sharp-edged tool. The speed of completion of the respective cleaning steps demands that at least the first-mentioned tool be made immediately available to the workman with its sharp edge exposed. This, however, poses safety problems in that the relatively broad sharp-edged cutting tool can be only supported on the workman's belt with the shank of the tool held in a loop or holster on the workman's belt, and, with the sharp edge of the tool openly exposed upwardly. In that position, the sharp edge is exposed to the worker's hands, arms, and body, and, it can inflict an injury to the workman upon movement of the workman's hands, arm, and body.

SUMMARY OF THE INVENTION

It is an object of this invention to provide a holder for a naked sharp-edged tool that will fully protect the workman against injury by the naked blade of the tool, while at the same time making the tool immediately available to the workman.

This is accomplished according to the present invention by providing a holder formed from a rigid material that can be hung or otherwise attached to the belt of the workman at an upper end of the holder.

The holder includes a downwardly extending portion that terminates at its lower end in a channel that extends forwardly of the holder, and, which terminates in an upstanding wall of sufficient height to shroud the sharp edge of the tool when inserted into the holder.

A clip is provided on the holder for firmly attaching the shank of the tool to the holder, with the sharp edge of the tool shrouded within the channel. Preferably, the lower-most portion of the channel is provided with a lining of an elastomeric material that provides a cushion for the sharp edge of the blade, thus protecting the sharp edge of the blade against abrasion and attrition while the tool is housed within the holder.

Having provided protection for both the workman and the sharp edge of the tool, the workman is then free to employ another tool, such as a retractable single-edged razor, which conveniently is supported on the front wall of the channel. Such single-edged razor blade holders are easy to manipulate with a single hand between the open and the retracted positions. Thus, the workman easily can "pick" the retractable single-edged razor blade holder from the front of the main holder, extend the blade, use the blade for its required purpose, retract the blade, and then, reinsert the razor blade holder into its support on the front wall of the channel, the workmen's hand and arms at all time being protected by the front edge of the channel against cutting or abrasion by the contained first-mentioned sharp-edged tool.

DESCRIPTION OF THE DRAWINGS

The invention will now be described with reference to the accompanying drawings, which illustrates a preferred embodiment of the invention, and, in which:

FIG. 1 is a perspective view of the holder of the invention taken from the front thereof;

FIG. 2 is a plan view of the holder;

DESCRIPTION OF THE PREFERRED EMBODIMENT

Figure 3:
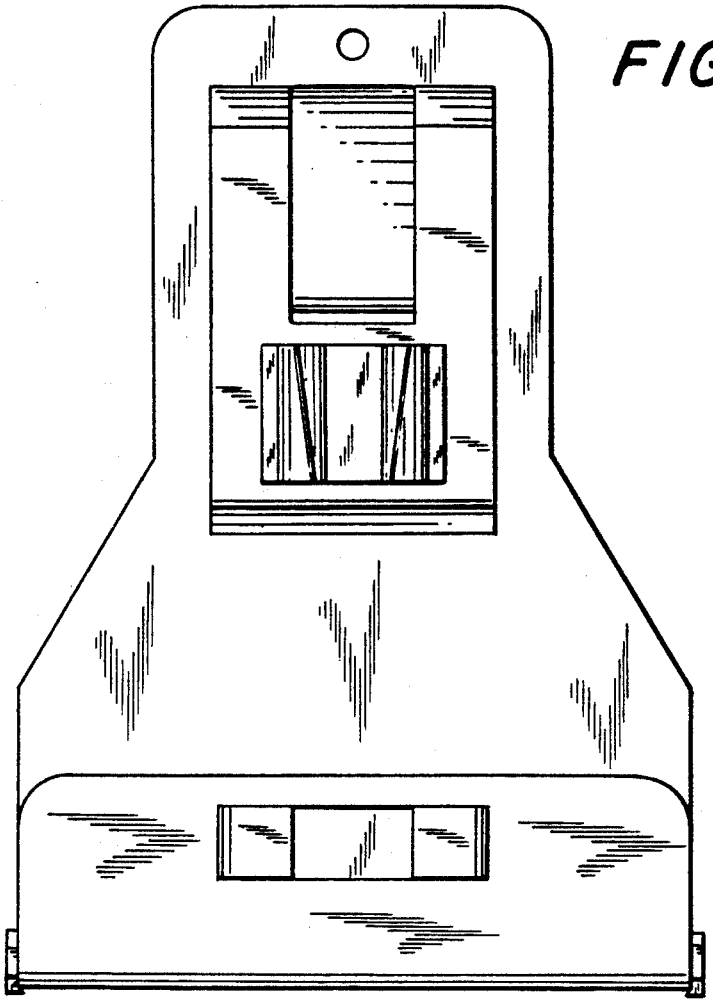
FIG. 3 is a front elevation of the holder.
Figure 4:
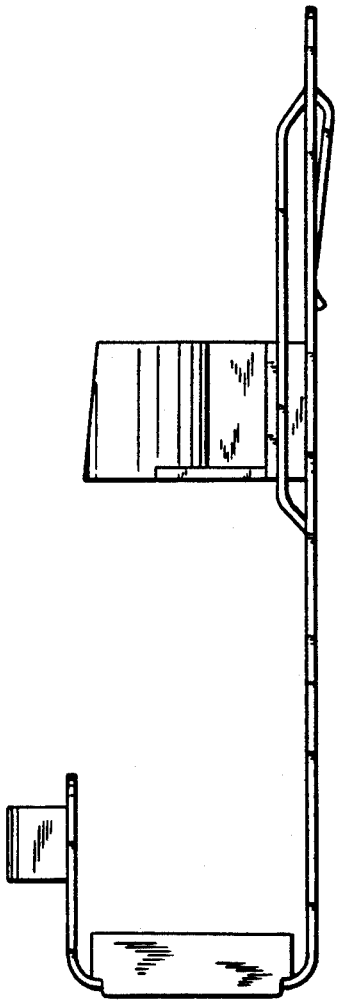
FIG. 4 is a right-side elevation of the holder, the left-side elevation being a mirror image of FIG. 4.
Figure 5:
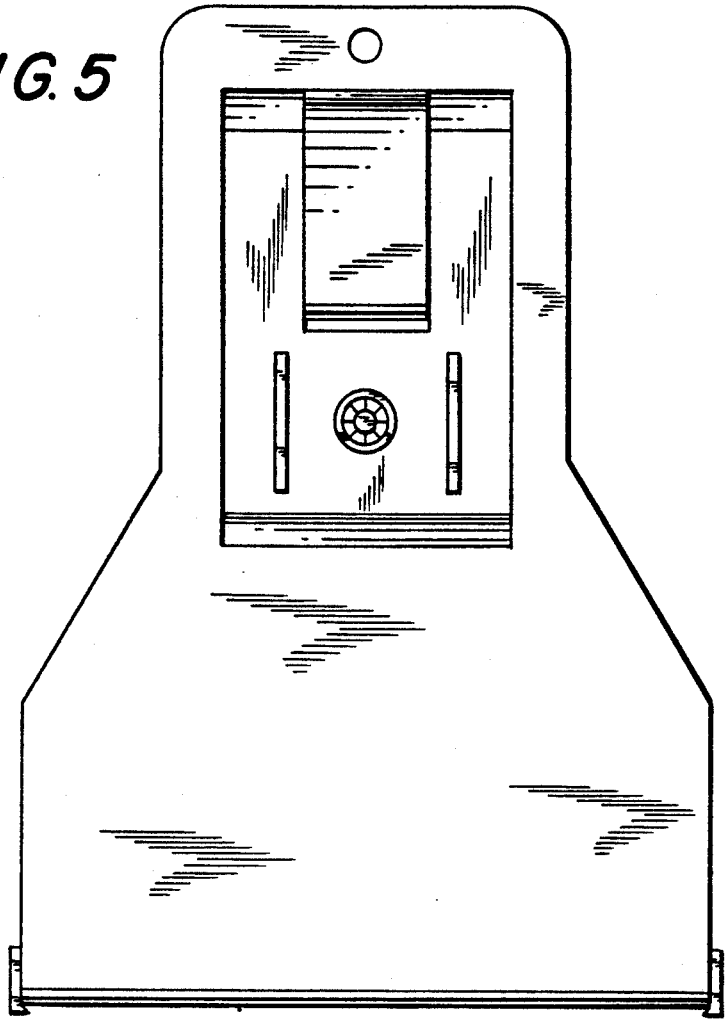
FIG. 5 is a rear view of the holder.
Figure 6:
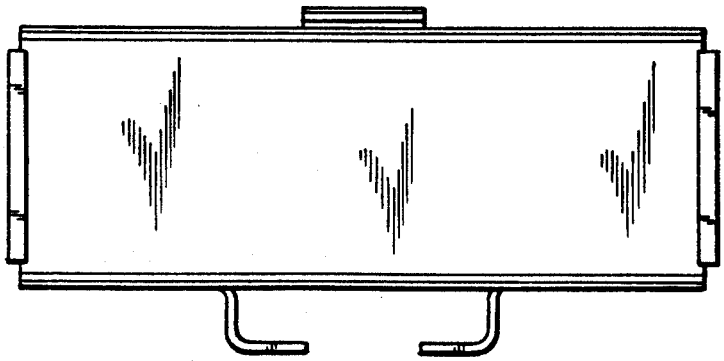
FIG. 6 is an underside plan view of the holder.

As illustrated in the drawings, the holder of the invention is in the form of a J-shaped member in transverse cross section, and includes an upstanding rear wall 10 that continues at its lower edge into a forwardly extending bottom wall 12. The bottom wall 12, in urn, proceeds into an upwardly extending front wall 14, the rear wall 10, the bottom wall 12 and the front wall 14 each being formed integrally with each other from a sheet of rigid material, such as mild steel, stainless steel, or any other material having a sufficient resistance to bending under normal usage and handling, including molded plastics materials.

Conveniently, the rear wall 10 is provided with a hole 16 at its uppermost portion, thus permitting the holder to be hung for storage on a nail or hook.

Adjacent its upper end, the rear wall 10 is formed to provide a U-shaped bridge 18, to the lower portion of which is secured a spring clip 20. Conveniently, the spring clip 20 can be a molding of plastics material, or, it can be in the form of a conventional spring clip formed from spring steel. The clip 20 can be secured to the bridge 18 by a rivet 21.

The bridge 18 extends forwardly of the main body 10, and, provides vertically extending slots 22, through which a workman's belt can be threaded, thus to attach the holder directly onto the workman's belt. In the alternative, the holder can be attached to the workman's belt by forcing a spring clip 24 rearwardly of the main body 10, and by then passing the spring clip over the uppermost edge of the workman's belt.

Thus, by the structure provided, either the holder can be attached directly to a workman's belt for the workman's belt and the holder to be handled as a single unit, or, in the alternative, the holder can be detachably attached to the workman's belt at the convenience of the workman.

The spring clip 20 is provided and suitably positioned for it to receive and embrace the shank 26 of a tool 28. Both of which are indicated in chain-dotted lines, and which form no part of the holder itself. The tool 28 can be of any width and construction, such a tool typically being of four or more inches in width, and, provided with a razor-sharp cutting blade.

Positioned over the bottom wall 12, and detachably attached thereto, is a pad 30 formed from a tough plastics material that is resistive to cutting and scratching, and which provides a cushioning effect for the razor-sharp blade of the tool 28 in the event that the blade is forced downwardly into contact with the pad 30, as will invariably occur during removal and insertion of the tool into the holder.

Preferably, the pad 30 is removably attached to the bottom wall 12, to permit its ready replacement when it becomes sufficiently worn and scarred by the cutting edge of the tool 28.

Positioned centrally of the front wall 14 is a clip 32, in which a retractable single-edged razor 34 can be stored. In that stored position, the razor 34 is completely accessible to the workman, who can remove it with ease, and then extend the retracted razor blade using only a single hand. Removal or replacement of the razor 34 can be performed in complete safety to the workman, the razor-sharp blade of the tool 28 at that time being shrouded by the front and bottom walls 12 and 30, and inaccessible contact with the workman's hand, fingers, or arm.

Upon replacement of the razor 34, which easily can be performed by tactile feel in the absence of direct vision, the workman can then employ, in complete safety, and again by tactile feel in the absence of direct vision, the same hand to remove the shank 26 from the spring clip 20, and then remove the tool 28 from the holder.

Conveniently, the clip 32 is provided by L-shaped arms that have been punched out of the body of the front wall 14. Alternatively, the clip 32 could be a molding of plastics material that has been attached to the front wall 14.

The rear wall 10 does not necessarily have to be of the shape illustrated in the drawings. The rear wall 10 does, however, have to provide an abutment surface that will protect the workman's body as the tool 28 is inserted into the channel provided by the bottom wall 12 and the front wall 14. Also, the pad 30 does not necessarily have to be substantially planar as is illustrated. If desired, the pad 30 can be provided with upstanding edge walls extending longitudinally of the pad 30 and which are formed of the same materials as the pad 30, thus further providing for protection of the sharp-edged blade as it is inserted into and removed from the holder.

What is claimed is:

1. A holder for a naked, sharp-edged workman's tool, comprising; a rear wall;

means adjacent an upper edge of said rear wall for securing said rear wall to a workman's belt;

said means including a bridge member providing a vertical slot extending parallel to the plane of said rear wall, said bridge member and said rear wall being operative to encircle a workman's belt, and secure said holder to said workman's belt in a manner prohibiting removal of said holder from said workman's belt other than in a direction longitudinally of said workman's belt, further including a spring clip located intermediate opposite edges of said bridge formed integrally with said rear wall for reception behind a workman's belt, with said rear wall positioned in front of said workman's belt, thus to provide an alternative manner of attachment of said holder to said workman's belt;

a bottom wall extending forwardly of a bottom edge of said rear wall;

a front wall extending upwardly from a forward edge of said bottom wall;

a spring means affixed to said rear wall and extending forwardly thereof for the reception of a shank of a workman's tool, and, a pad of cushioning material overlying said bottom wall, and substantially coextensive therewith;

said holder providing for the storage of said naked, sharp-edged tool, by first positioning said sharp-edge of said tool on said cushioning pad, and by then attaching said shank of said tool to said rear wall by means of said spring means, whereby said sharp edge of said tool is shrouded by said front, bottom and rear walls and is inaccessible to the workman's fingers, hands or arms;

further including retention means for the reception of a retractible single-edged razor positioned on said front wall.

2. The holder of claim 1, in which said rear wall, said bottom wall and said front wall are formed integrally with each other.

3. The holder of claim 1, in which said clip retention means on said front wall is provided by L-shaped arms that have been struck out of said front wall.

* * * * *